United States Patent [19]

Hinkley

[11] 3,998,604

[45] Dec. 21, 1976

[54] DEMINERALIZATION OF BROWN COAL

[75] Inventor: David William Hinkley, Brighton Beach, Australia

[73] Assignee: International Oils Exploration N.L., Melbourne, Australia

[22] Filed: Sept. 23, 1974

[21] Appl. No.: 508,262

[52] U.S. Cl. ..... 44/1 R; 209/3; 209/10; 209/166; 44/1 C

[51] Int. Cl.[2] ..... B03B 1/04

[58] Field of Search ..... 209/3, 49, 166, 167, 209/10, 9; 241/20, 24; 423/449, 401; 44/51, 1 R

[56] References Cited

UNITED STATES PATENTS

| | | | |
|---|---|---|---|
| 793,808 | 7/1905 | Sulman | 209/166 |
| 1,552,197 | 9/1925 | Bates | 209/166 |
| 1,788,331 | 1/1931 | Schafer | 209/167 |
| 2,142,207 | 1/1939 | Price | 209/165 |
| 2,346,151 | 4/1944 | Burk | 44/51 X |
| 3,501,272 | 3/1970 | Benyk | 423/461 |

FOREIGN PATENTS OR APPLICATIONS

| | | | |
|---|---|---|---|
| 545,623 | 7/1922 | France | 209/166 |
| 708,199 | 6/1941 | Germany | 209/166 |
| 259,348 | 6/1928 | Italy | 423/461 |
| 26,855 | 12/1903 | Japan | 423/461 |
| 17,731 | 6/1915 | United Kingdom | 423/461 |
| 173,072 | 12/1921 | United Kingdom | 44/1 R |

OTHER PUBLICATIONS

Chem. Abst. 78, 1973, 161905z.

Gaudin, Flotation, McGraw–Hill, 1957, p. 543.

*Primary Examiner*—Robert Halper

[57] ABSTRACT

Demineralization of coal in which a slurry of the coal to be treated is ground in the presence of aqueous acid such as HCl $H_2SO_4$ and $H_2CO_3$ and then the slurry is subjected to froth flotation in the presence of a gas selected from $Cl_2$, $SO_2$, or $CO_2$.

11 Claims, 1 Drawing Figure

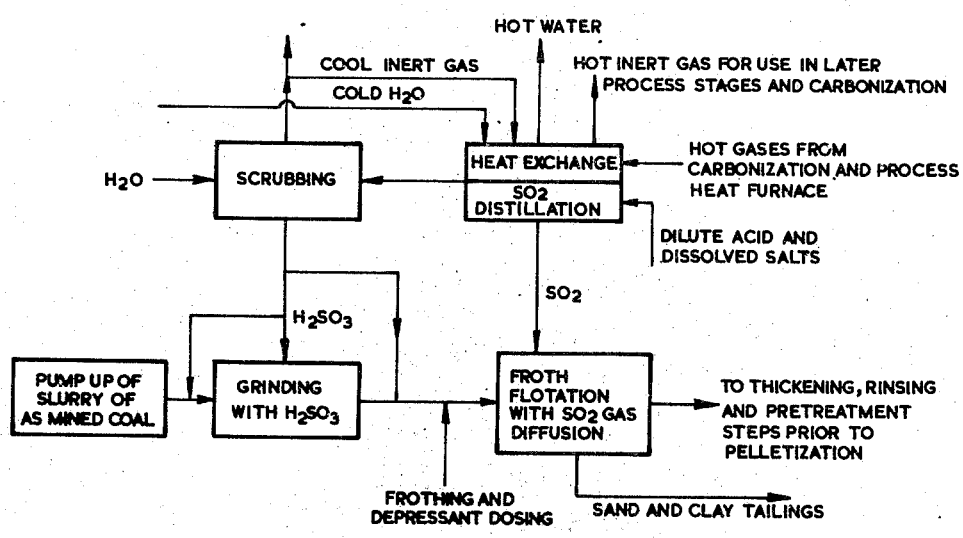

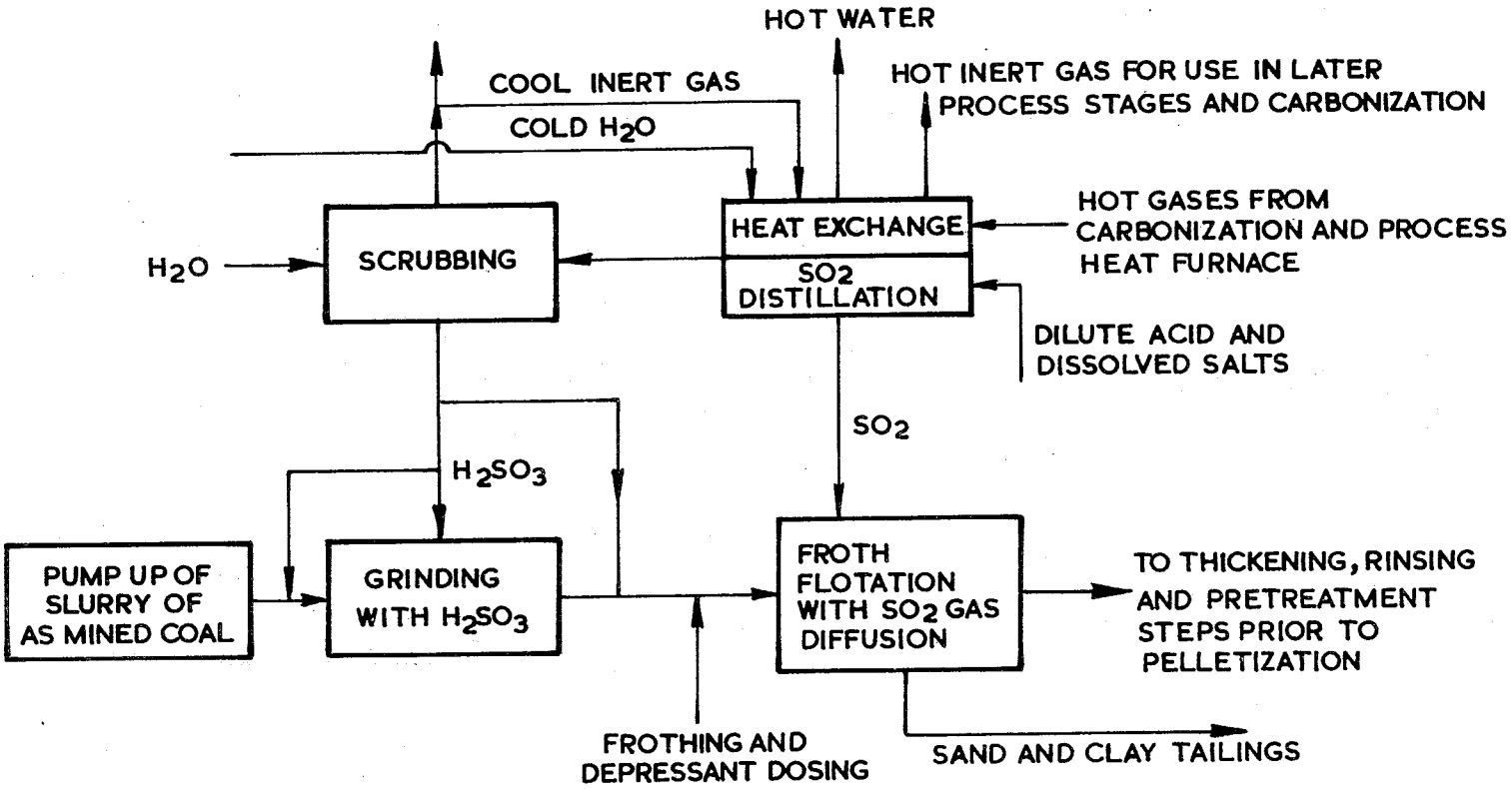
HOT WATER
HOT INERT GAS FOR USE IN LATER PROCESS STAGES AND CARBONIZATION
HOT GASES FROM CARBONIZATION AND PROCESS HEAT FURNACE
DILUTE ACID AND DISSOLVED SALTS
HEAT EXCHANGE
SO2 DISTILLATION
SO2
FROTH FLOTATION WITH SO2 GAS DIFFUSION
TO THICKENING, RINSING AND PRETREATMENT STEPS PRIOR TO PELLETIZATION
SAND AND CLAY TAILINGS
FROTHING AND DEPRESSANT DOSING
COOL INERT GAS
COLD H2O
SCRUBBING
H2O
H2SO3
GRINDING WITH H2SO3
PUMP UP OF SLURRY OF AS MINED COAL

DEMINERALIZATION OF BROWN COAL

This invention relates to the demineralization of coal and especially of brown coal.

Brown coal deposits are present in several localities in Austrialia and brown coal is being exploited as a source of activated carbons, for use as electrodes and as reductants. Brown coal, in its raw state, is quite reactive due to the high content of volatiles, water and inorganic minerals. Difficulty has been met in producing brown coal char of low ash and high granular strength. It is necessary to remove the inorganic impurities from the coal in a series of demineralizing steps and then to form the coal into briquettes and then dry and carbonize these briquettes.

This invention is predicated upon the discovery that by early acid treatment of the coal, maximum ash reduction can be attained. The acid used can be hydrochloric acid or other suitable mineral acids. Also this invention, in a preferred aspect, is based on the discovery that carbonic and sulfurous acids can be recovered from gases exiting from a carbonization plant and utilized in the acidic treatment of the coal.

The invention provides a process for treating coal, especially brown coal, which includes the steps of forming the coal into a slurry, preferably having a water to weight ratio below three to one, subjecting this slurry to a grinding treatment in the presence of aqueous acid, preferably selected from sulfurous, carbonic, hydrochloric or mixtures of these acids, passing the thus treated slurry to a froth flotation treatment in which an acidic gas, corresponding to the acid of the grinding step, is dissolved in the incoming slurry to maintain acid concentration and the coal particles then being withdrawn either as the "floats" or "sinks" (depending on the flotation reagents selected) to be further treated.

The aqueous acid may be added to the coal slurry before entering the grinder and may be added at the stage of forming the as mined coal into a slurry. Alternatively, the acid can be added during grinding. The grinding operation in the presence of the acid ensures comprehensive treatment of the coal as the continuous attrition exposes new surfaces to acid and this results in a more effective treatment.

The acid and coal are then passed to froth flotation where $SO_2$ is drawn down and dissolved in the stream by a sparging tube fitted round the impeller-frother system. Alternatively, $SO_2$ and compressed air can be used as a frothing medium. The acidic tailing stream and/or the dissolved salts stream drawn from the flotation circuit may be recycled to a flash evaporator for distillation of $SO_2$ gas for re-use in the acid circuit. The sand and clay tailings are also removed separately at this point in the treatment.

The residence time of acid in these treatment steps from slurry formation to exit from the froth flotation may be of the order of one to four hours, depending on the proportion of inorganic materials in the coal. The residence time will thus depend on the ash content of the coal.

The process steps outlined above are ordinarily sufficient for the demineralization of coal so that it can proceed to carbonization. Coal demineralized in this way, and then carbonized, is useful as activated carbon. If the carbon is to be used in electrodes, it is usual to further reduce the ash content by following the demineralization process of this invention with an alkali treatment.

The accompanying sheet of drawings illustrates a flow chart depicting a preferred arrangement of the demineralization steps according to the present invention.

The brown coal is formed into a slurry with water and is pumped from the open cut mine to the treatment plant. Some sulphurous acid is added to the slurry prior to grinding and the remainder is added during grinding. The ground slurry is then doped with frothing agents and passed to the froth flotation tank into which $SO_2$ is bubbled. The coal slurry withdrawn is thickened and passes to the subsequent treatment steps preparatory to carbonization.

The flow diagram, which is only a segment of a total plant operation, indicates that hot gases from the carbonization plant are used in heat exchange to distill $SO_2$ from the dilute acid and dissolved salts emanating from the froth flotation and thickening steps. Hot water withdrawn from this treatment is utilized in other parts of the plant. The remaining hot gases pass to the scrubber to remove acidic gases especially $SO_2$ to form sulphurous acid for use in the grinding step.

The treatment steps according to the present invention form part of an overall process which demineralizes brown coal and then pelletizes, dries and carbonizes the coal. In such a case, the heat generated in the carbonization plant can be utilized in the production of the sulphurous acid used in the grinding treatment.

Fuel gases emanating from the carbonization plant are dosed with elemental sulphur premixed with coal and combusted to obtain additional $SO_2$ in the resultant flue gas to supplement that derived from the sulphur in the as mined coal.

The heat from the flue gas loaded with $SO_2$ is used in heat exchange for a. recovery distillation of $SO_2$ from downstream sullage emanating from the froth flotation treatment;
b. drying of coal feed prior to briquetting or granulation; and
c. for steam raising in the downstream alkali treatment which uses $NH_4Cl$.

After scrubbing this flue gas, dilute sulphurous acid is taken off for the grinding treatment.

The cool flue gas emanating from the heat exchanger scrubber treatment sections, is recycled to storage from where it can be drawn off and used for cooling and heat absorption from the briquettes exiting from the carbonization treatment.

The coal withdrawn from the froth flotation treatment may be either subjected to further treatment to reduce the ash content to render the coal suitable for use as electrode carbon, or alternatively, it may be passed direct to the pre-treatment stages leading to carbonization for the purposes of preparing activated carbon.

The process of this invention is part of an overall processing of brown coal from as mined coal to the final active char product. It overcomes the economic difficulties of the prior art by providing process steps which lend themselves to use of recycled flue gas products such as sulphurous acid and carbonic acid from scrubbed flue gas and $SO_2$ from distillation of downstream sullage.

The use of these recycled products in the grinding and froth flotation stages provides an acid environment which assists separation of certain sand and clays present in the coal. Furthermore, the combination of the acid treatment with grinding economizes the overall power expense involved.

I claim:

1. A brown coal demineralization process which includes the steps of forming the as mined brown coal into a slurry, grinding said slurry in the presence of aqueous sulphurous acid, subjecting said ground slurry to a froth flotation treatment in the presence of flotation reagents in which $SO_2$ is dissolved in the slurry to maintain acid concentration and withdrawing said brown coal for further downstream treatment.

2. The process of claim 1 in which said $SO_2$ is dissolved in the incoming slurry to the froth flotation treatment.

3. A demineralization process for low ranking coals such as brown coal which comprises the steps of forming the coal into a slurry, grinding said slurry in the presence of an aqueous acid selected from the group consisting of:

a. hydrochloric
b. sulphurous
c. carbonic acids and
d. mixtures of acids (a), (b) and (c), subjecting the ground slurry to a froth flotation treatment in the presence of flotation agents in which a respective gas selected from the group consisting of:
a. chlorine
b. sulphur dioxide
c. carbon dioxide and
d. mixtures of gases (a), (b) and (c) is dissolved in the slurry to maintain concentration of said acid, withdrawing separated coal particles and passing them to downstream treatment stages.

4. A process as claimed in claim 3 wherein said aqueous acid is added to the slurry prior to grinding.

5. A process as claimed in claim 3 wherein said aqueous acid is added to the slurry during grinding.

6. The process of claim 3 in which said acidic gas is introduced into the incoming slurry to said froth flotation treatment.

7. The process of claim 3 in which the acidic gas is introduced into froth flotation with compressed air.

8. The process of claim 3 in which the acid is hydrochloric acid and the gas is chlorine.

9. The process of claim 3 in which the acid is sulphurous acid and the gas is sulphur dioxide.

10. The process of claim 3 in which the acid is carbonic acid and the gas is carbon dioxide.

11. The process of claim 3 in which said acids are sulphuric acid and carbonic acid, said respective gases are sulphur dioxide and carbon dioxide, and the source of said acids and gases is the flue gases from a carbonizing plant in the downstream treatment.

* * * * *